US011282467B1

(12) United States Patent
Tu et al.

(10) Patent No.: US 11,282,467 B1
(45) Date of Patent: Mar. 22, 2022

(54) DISPLAY DEVICE

(71) Applicant: HIMAX TECHNOLOGIES LIMITED, Tainan (TW)

(72) Inventors: Yi-Ping Tu, Tainan (TW); Ming-Hung Weng, Tainan (TW); Cheng-Che Tsai, Tainan (TW); Yao-Chieh Li, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 17/138,788

(22) Filed: Dec. 30, 2020

(51) Int. Cl.
*G09G 3/36* (2006.01)

(52) U.S. Cl.
CPC ..... *G09G 3/3607* (2013.01); *G09G 3/3677* (2013.01); *G09G 3/3688* (2013.01); *G09G 2300/0452* (2013.01); *G09G 2310/0202* (2013.01); *G09G 2310/027* (2013.01); *G09G 2310/0291* (2013.01); *G09G 2310/08* (2013.01)

(58) Field of Classification Search
CPC combination set(s) only.
See application file for complete search history.

(56) References Cited

U.S. PATENT DOCUMENTS

2007/0132684 A1* 6/2007 Baek ..... G09G 3/3614 345/87
2013/0314389 A1* 11/2013 Wang ..... G09G 3/3648 345/211
2014/0139255 A1* 5/2014 Chen ..... G09G 3/006 324/760.01
2014/0160174 A1* 6/2014 Tsu ..... G09G 5/06 345/690
2016/0085116 A1* 3/2016 Iwatsu ..... G02F 1/136286 349/144
2018/0108307 A1* 4/2018 Sakurai ..... G02F 1/1368
2020/0225527 A1 7/2020 Long et al.
2020/0365102 A1* 11/2020 Chang ..... G09G 3/36
2021/0159295 A1* 5/2021 Miao ..... H01L 27/3265

FOREIGN PATENT DOCUMENTS

TW 201835889 A 10/2018

* cited by examiner

*Primary Examiner* — Van N Chow
(74) *Attorney, Agent, or Firm* — CKC & Partners Co., LLC

(57) ABSTRACT

A display device includes a display panel, a gate driving circuit and a source driving circuit. The display panel includes multiple sub-pixels arranged in multiple rows and multiple columns. Three first sub-pixels of the sub-pixels have different colors and constitute one pixel. The first sub-pixels are disposed in the same column. The gate driving circuit is electrically connected to multiple gate lines. The number of the gate lines is less than the number of the rows. Each of the gate lines corresponds to at least two of the rows. Each of the gate lines is electrically connected to at least two of the sub-pixels in each of the columns. The source driving circuit is electrically connected to multiple data lines. The number of the data lines is greater than the number of the columns. Each of the columns corresponds to at least two of the data lines.

3 Claims, 9 Drawing Sheets

DISPLAY DEVICE

BACKGROUND

Field of Invention

The disclosure relates to a display device capable of striking a balance between charging time and cost.

Description of Related Art

A conventional display device includes a gate driving circuit, a source driving circuit and sub-pixels. The gate driving circuit is electrically connected to the sub-pixels through gate lines. The source driving circuit is electrically connected to the sub-pixels through data lines. In a period of a frame, the gate driving circuit sequentially turns on thin film transistors (TFT) of the sub-pixels row by row, and the source driving circuit transmits grey-level signals to the sub-pixels through the data lines to charge a capacitor of each sub-pixel. As the resolution of the display device increases, the time for charging each sub-pixel becomes shorter. On the other hand, the increase of the data lines leads to the need to dispose more source driving circuits, which will increase the cost. It is an issue concern to those skilled in the art about how to strike a balance between the charging time and the cost.

SUMMARY

Embodiments of the present disclosure provide a display device including a display panel, a gate driving circuit and a source driving circuit. The display panel includes multiple sub-pixels arranged in multiple rows and multiple columns. Three first sub-pixels of the sub-pixels have different colors and constitute one pixel. The first sub-pixels are disposed in a same column of the columns. The gate driving circuit is electrically connected to multiple gate lines. The number of the gate lines is less than the number of the rows. Each of the gate lines corresponds to at least two of the rows. Each of the gate lines is electrically connected to at least two of the sub-pixels in each of the columns. The source driving circuit is electrically connected to multiple data lines. The number of the data lines is greater than the number of the columns. Each of the columns corresponds to at least two of the data lines. The at least two of the data lines alternatively and electrically connected to the sub-pixels in the corresponding column.

In some embodiments, two of the first sub-pixels are electrically connected to a same one of the gate lines and respectively and electrically connected to different two of the data lines. In a period that the gate driving circuit turns on the two of the first sub-pixels, the source driving circuit transmits two grey-level signals to the two of the first sub-pixels through the different two of the data lines respectively.

In some embodiments, the first sub-pixels are electrically connected to a same one of the gate lines and respectively and electrically connected to different three of the data lines. In a period that the gate driving circuit turns on the first sub-pixels, the source driving circuit transmits three grey-level signals to the first sub-pixels through the different three of data lines.

In some embodiments, the first sub-pixels and a second sub-pixel are disposed in a same one of the columns. The first sub-pixels and the second sub-pixel are electrically connected to a same one of the gate lines and respectively and electrically connected to different four of the data lines. In a period that the gate driving circuit turns on the first sub-pixels and the second sub-pixel, the source driving circuit transmits four grey-level signals to the first sub-pixels and the second sub-pixel through the different four of the data lines respectively.

In some embodiments, every n sub-pixels in each of the columns are electrically connected to a same one of the gate lines. n is a positive integer greater than or equal to 2.

In some embodiments, the n sub-pixels are electrically connected to different n data lines.

BRIEF DESCRIPTION OF THE DRAWINGS

The invention can be more fully understood by reading the following detailed description of the embodiment, with reference made to the accompanying drawings as follows.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size.

The using of "first", "second", "third", etc. in the specification should be understood for identifying units or data described by the same terminology, but are not referred to particular order or sequence.

Figure 1:
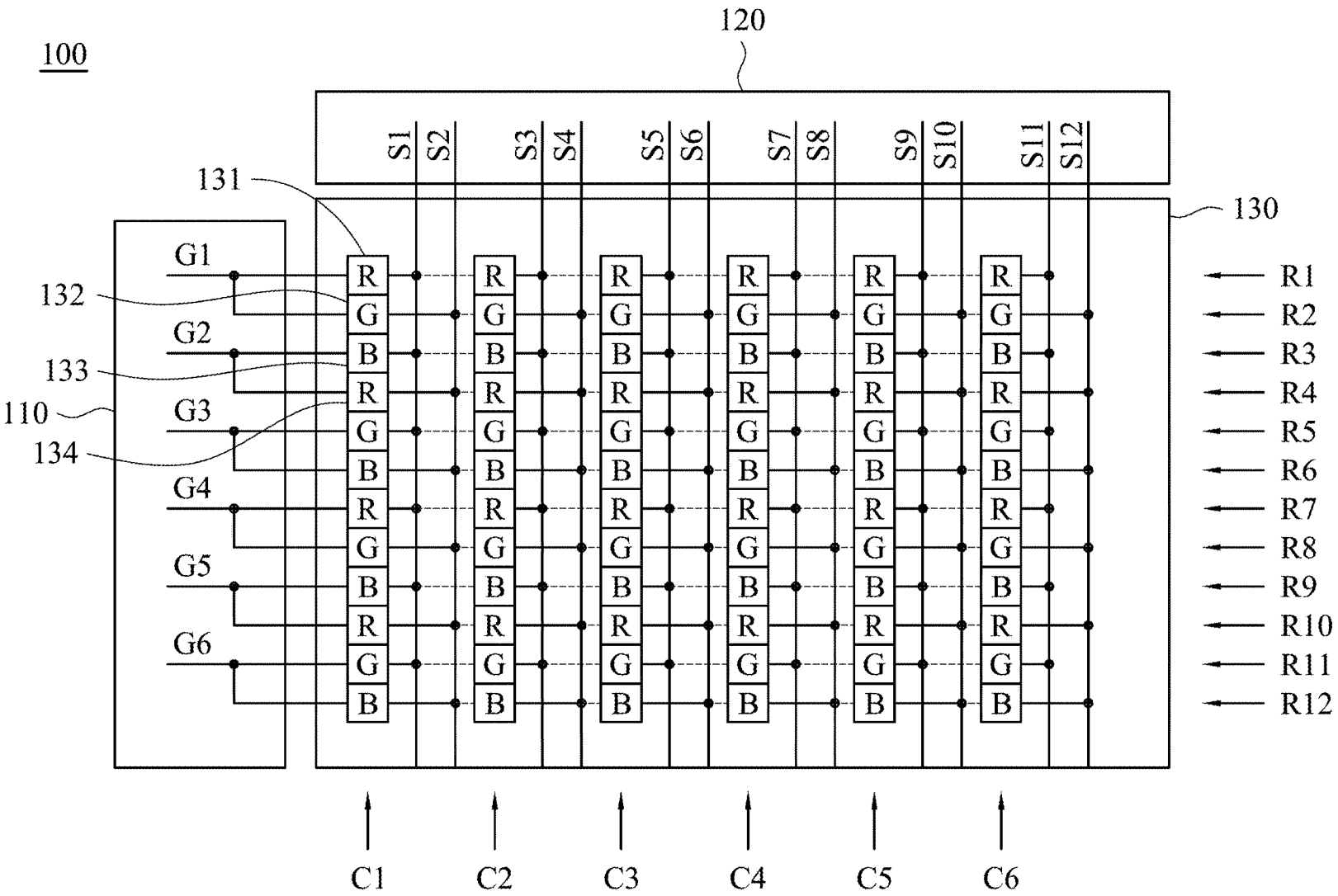
FIG. 1 is a schematic diagram of a display device in accordance with an embodiment.

FIG. 1 is a schematic diagram of a display device in accordance with an embodiment. Referring to FIG. 1, a display device includes a gate driving circuit 110, a source driving circuit 120 and a display panel 130. The display panel 130 includes multiple sub-pixels arranged in columns C1-C6 and rows R1-R12. Each sub-pixel has a particular color. The symbols of "R", "G" and "B" in FIG. 1 represents colors of red, green and blue respectively. In the embodiment, one pixel includes three sub-pixels with different colors that are arranged vertically, and that is, disposed in the same column. For example, sub-pixels 131-133 constitute a pixel and arranged vertically; a sub-pixel 134 is disposed in the same column but belongs to another pixel. In this case, the number of the columns is reduced and the number of rows is increased.

The gate driving circuit 110 is electrically connected to gate lines G1-G6. The number of the gate lines G1-G6 is less than the number of the rows R1-R12. Each of the gate lines corresponds to two rows. For example, the gate line G1 corresponds to the rows R1 and R2; the gate line G2 corresponds to the rows R3 and R4, and so on. In the embodiment, each gate line is electrically connected to at least two sub-pixels in each column. For example, the gate line G1 is electrically connected to the sub-pixel 131 and the sub-pixel 132; the gate line G2 is electrically connected to the sub-pixel 133 and the sub-pixel 134, and so on.

The source driving circuit 120 is electrically connected to data lines S1-S12. The number of the data lines S1-S12 is greater than the number of the columns C1-C6. Each column corresponds to two data lines. For example, the column C1 corresponds to the data lines S1 and S2; the column C2 corresponds to the data lines S3 and S4, and so on. Two data lines correspond to the same column are alternatively and electrically connected to the sub-pixels in the column. For example, the data line S1 is electrically connected to the sub-pixel 131 and the sub-pixel 133, the data line S2 is electrically connected to the sub-pixel 132 and the sub-pixel 134, and so on.

Figure 2:
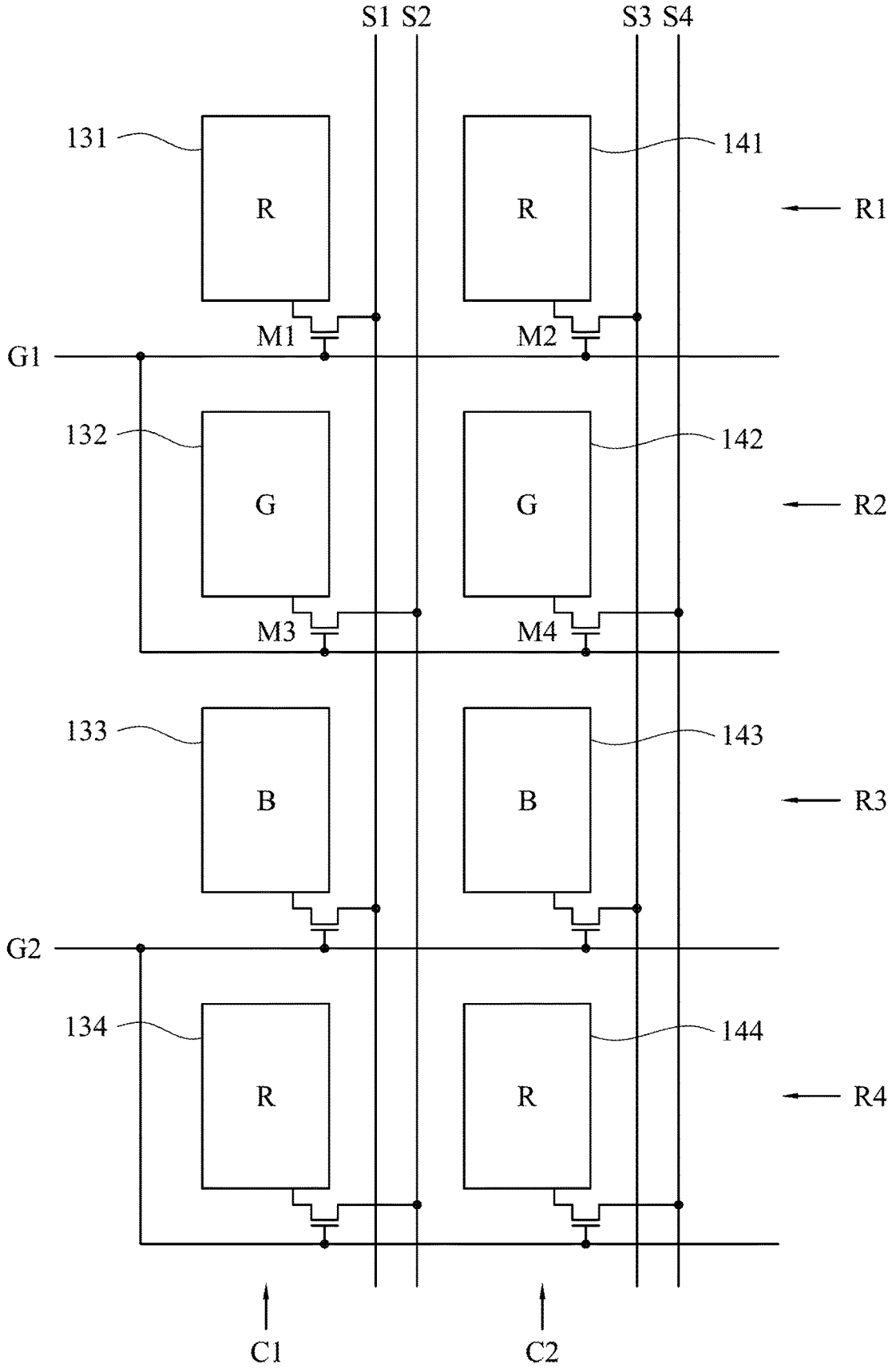
FIG. 2 is a schematic diagram of connections between multiple sub-pixels in accordance with an embodiment.

Note that the gate lines G1-G6 are also electrically connected to the sub-pixels in the columns C2-C6 by dotted lines. For example, the gate line G1 is also electrically connected to the sub-pixels "R" and "G" in the columns C2-C6 and rows R1 and R2. The detailed connection of the sub-pixels is shown in FIG. 2 where the sub-pixels in the columns C1 and C2 and in the rows R1 to R4 are taken as examples. Each sub-pixel includes a thin film transistor (TFT). The gate line G1 is electrically connected to gates of TFTs M1-M4. The drain of each TFT is electrically connected to a pixel electrode of the corresponding sub-pixel. The source of the TFT M1 is electrically connected to the data line S1; the source of the TFT M2 is electrically connected to the data line S3; the source of the TFT M3 is electrically connected to the data line S2; the source of the TFT M4 is electrically connected to the data line S4. In other words, the sub-pixels 131 and 132 are electrically connected to the same gate line G1 and respectively and electrically connected to different data lines S1 and S2; the sub-pixels 141 and 142 are electrically connected to the same gate line G1 and respectively and electrically connected to different data lines S3 and S4, and so on.

In a period of showing a frame, the gate driving circuit 110 turns on the TFTs through the gate lines (this operation is also referred to "turn on the sub-pixels" in the disclosure), and the source driving circuit 120 transmits grey-level signals to the sub-pixels through the data lines. A common electrode and the pixel electrode of each sub-pixel form a capacitor which is charged based on the corresponding grey-level signal. In the embodiment, the source driving circuit 120 includes a buffer for each data line. The grey-level signals are temporarily stored in the buffers before they are transmitted through the data lines. When the sub-pixels are turned on, the grey-level signals are then transmitted through the data lines. To be specific, referring to FIG. 2 and FIG. 3, in a time period 310, the source driving circuit 120 temporarily stores the grey-level signal for the sub-pixel 131 in the buffer of the data line S1 and temporarily stores the grey-level signal for the sub-pixel 132 in the buffer of the data line S2. The grey-level signals for the sub-pixels 141 and 142 are also stored in the buffers of the data lines S3 and S4 which are not shown in FIG. 3 for simplification. In a time period 320, the gate line G1 is at a high level to turn on the TFTs M1-M4, and the grey-level signals in the buffers are transmitted to the sub-pixels 131, 132, 141, and 142 through the data lines S1-S4. In the time period 320, the grey-level signals for the sub-pixels 133, 134, 143 and 144 are temporarily stored in the buffers of the data lines S1-S4. The gate line G2 is at the high level in the next time period, and so on.

Figure 4:
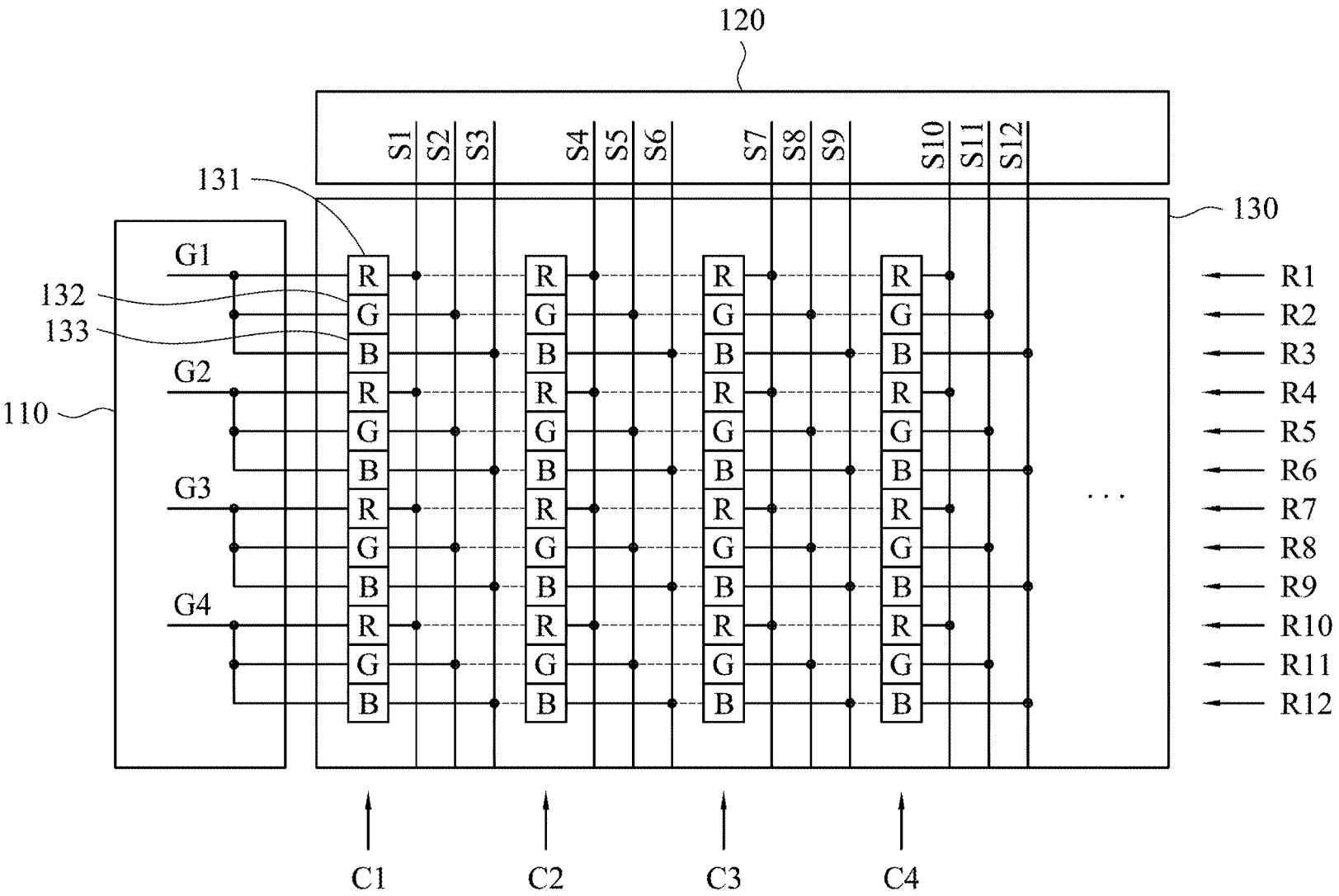
FIG. 4 is a schematic diagram of a display device in accordance with an embodiment.
Figure 5:
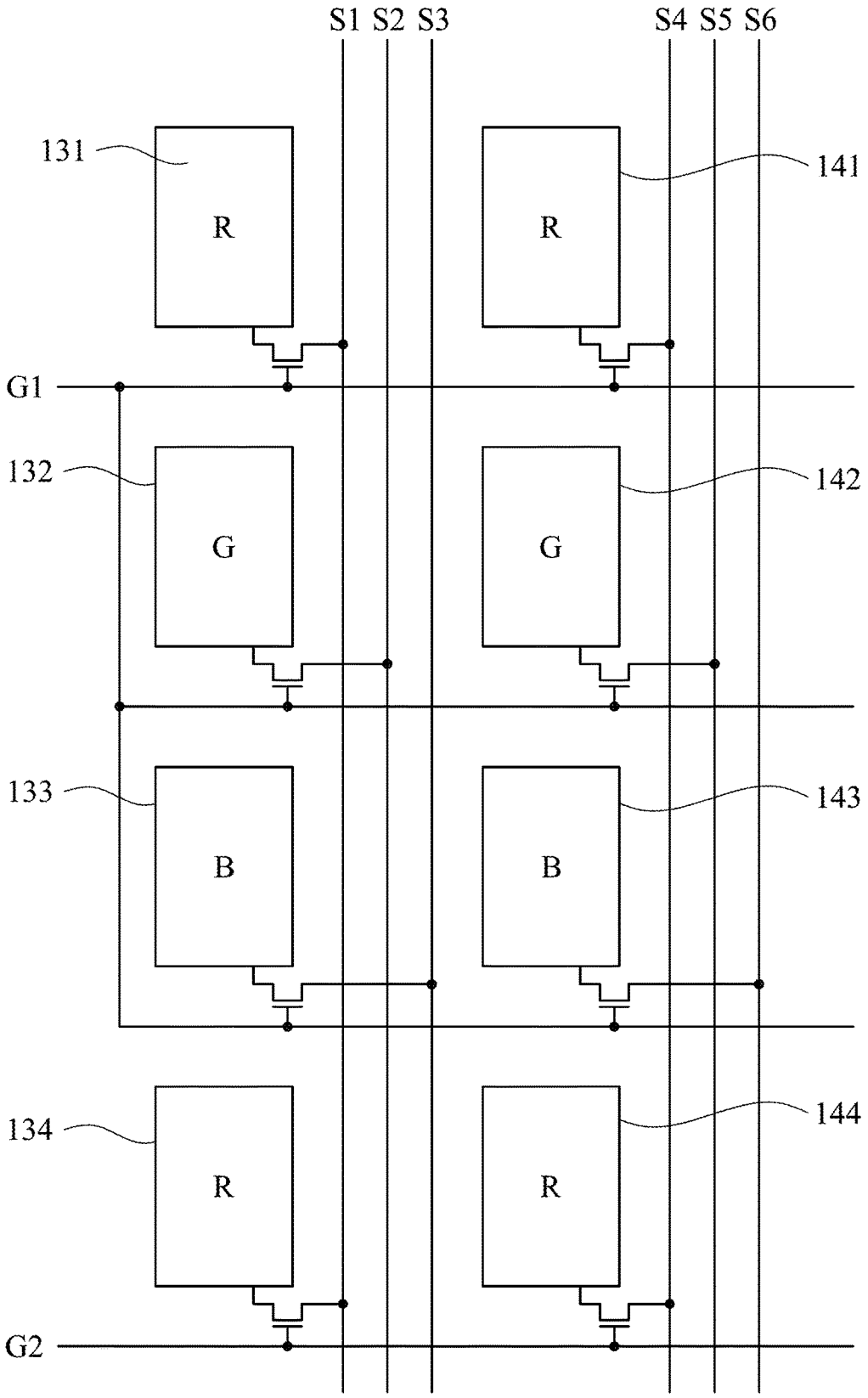
FIG. 5 is a schematic diagram of connections between multiple sub-pixels in accordance with an embodiment.
Figure 6:
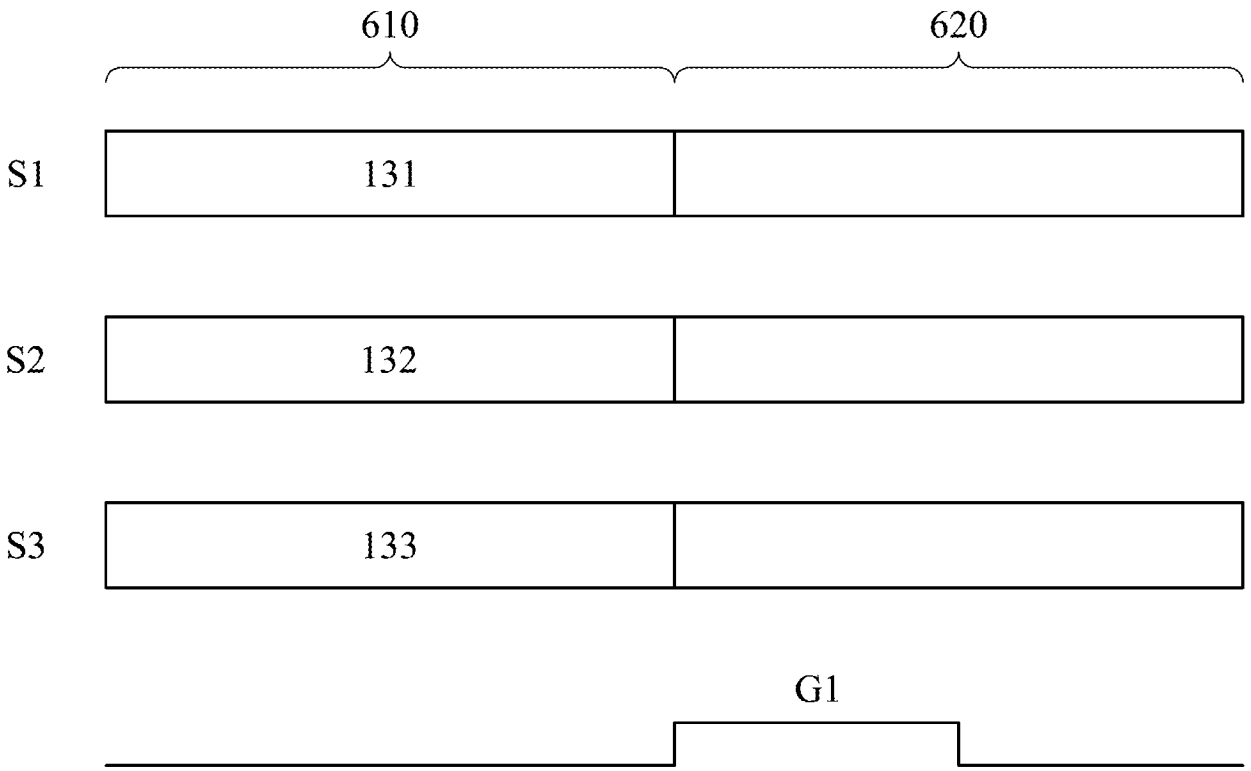
FIG. 6 is a signal timing diagram in accordance with an embodiment.

FIG. 4 is a schematic diagram of a display device in accordance with an embodiment. In the embodiment of FIG. 4, each gate line is electrically connected to three sub-pixels in the same column. For example, the sub-pixels 131-133 are electrically connected to the same gate lines G1 and respectively and electrically connected to the data lines S1-S3. Referring to FIG. 5 and FIG. 6, the gat line G1 is electrically connected to the gates of the TFTs of the sub-pixels 131-133 and 141-143. In a time period 610, the source driving circuit 120 stores the grey-level signals for the sub-pixels 131-133 in the buffers of the data lines S1-S3, and stores the grey-level signals for the sub-pixels 141-143 in the buffers of the data lines S4-S6. In a time period 620, the gate line G1 is at the high level, and the grey-level signals in the buffers are transmitted to the sub-pixels 131-133 through the data lines S1-S3 and to the sub-pixels 141-143 through the data lines S4-S6.

Figure 7:
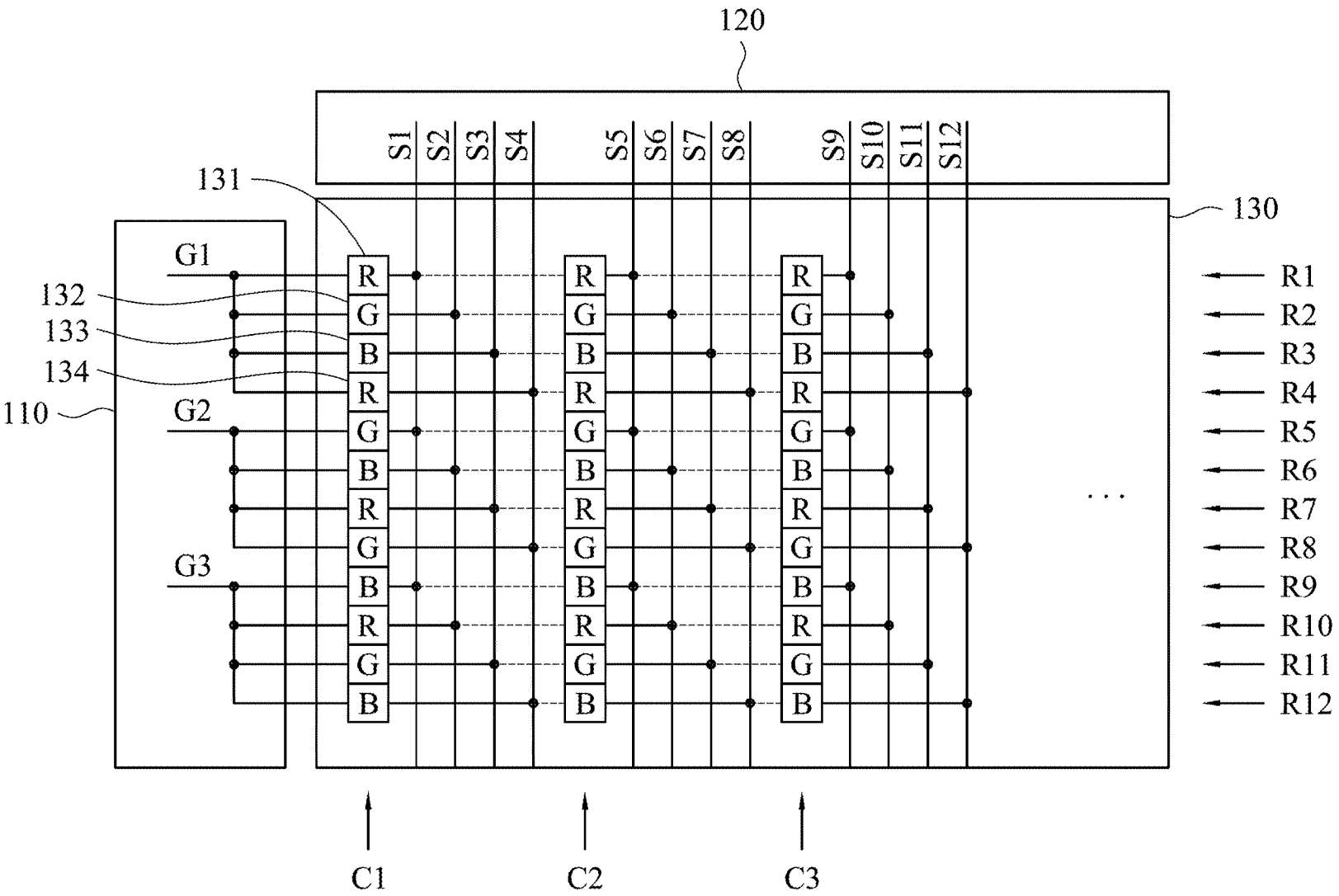
FIG. 7 is a schematic diagram of a display device in accordance with an embodiment.
Figure 8:
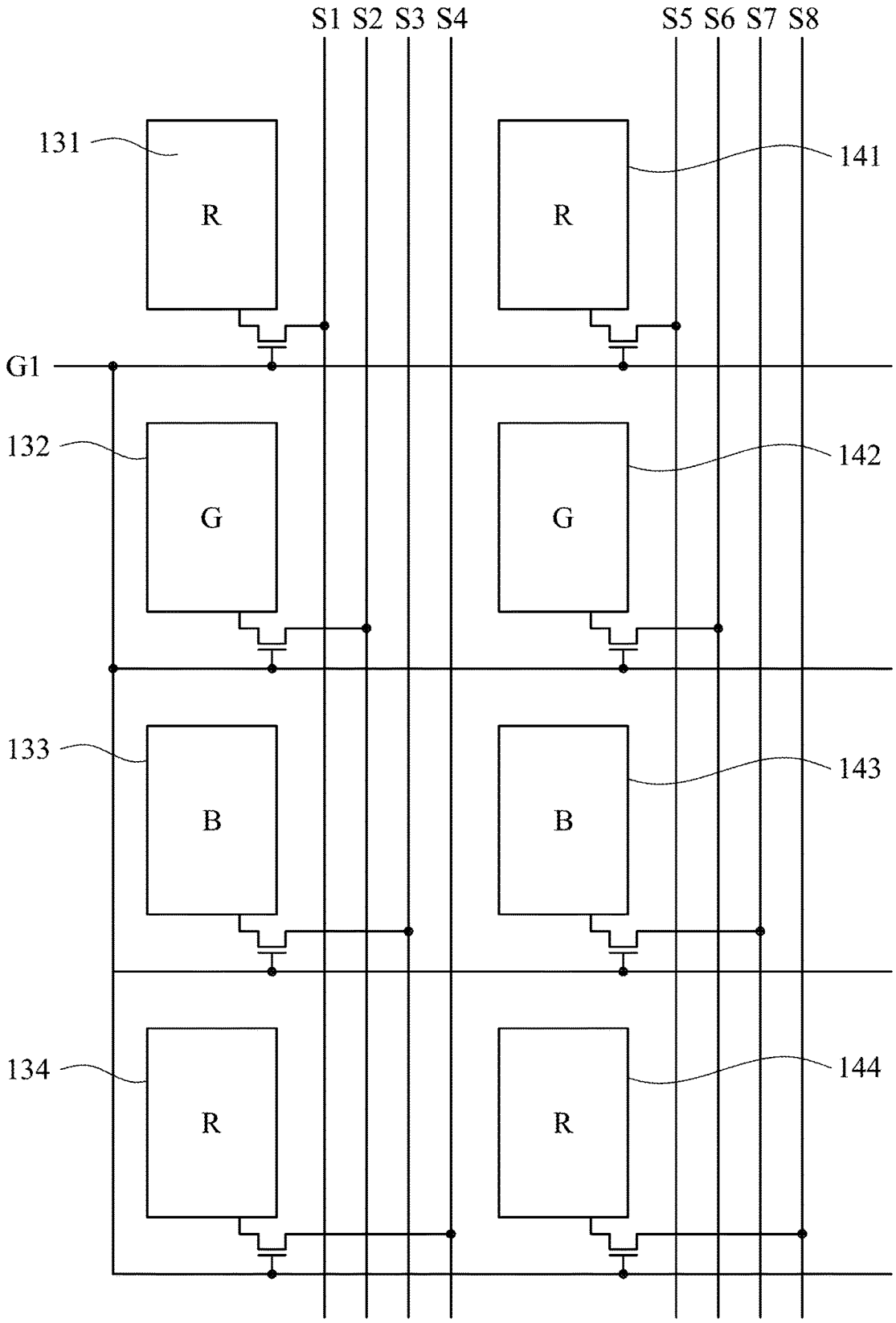
FIG. 8 is a schematic diagram of connections between multiple sub-pixels in accordance with an embodiment.
Figure 9:
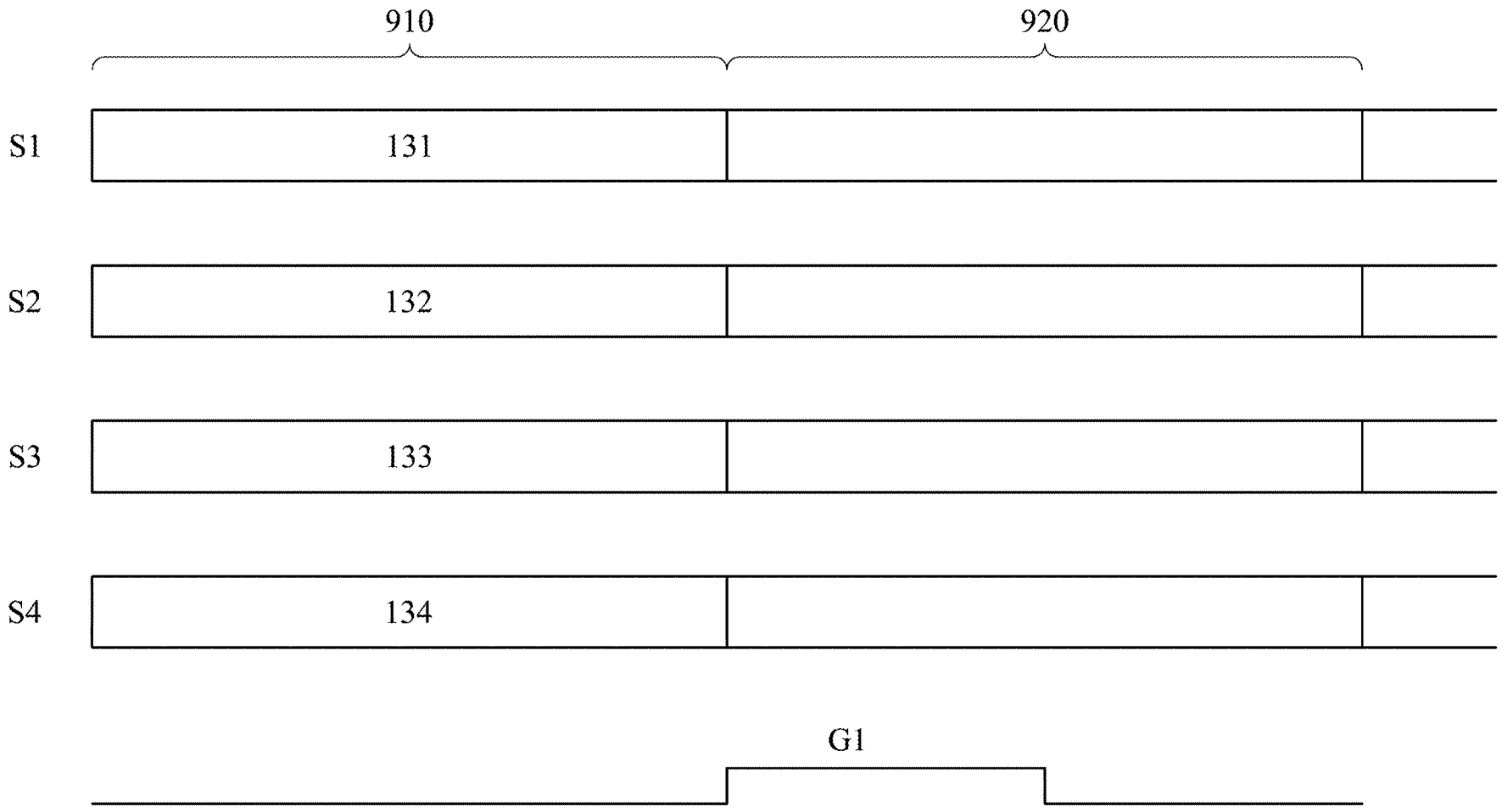
FIG. 9 is a signal timing diagram in accordance with an embodiment.

FIG. 7 is a schematic diagram of a display device in accordance with an embodiment. In the embodiments of FIG. 7, each gate line is electrically connected to four sub-pixels in the same column. For example, the sub-pixel 131-134 are electrically connected to the same gate line G1 and respectively and electrically connected to the data lines S1-S4. Referring to FIG. 8 and FIG. 9, the gate line G1 is electrically connected to the gates of the TFTs of the sub-pixels 131-134 and 141-144. In a time period 910, the source driving circuit 120 stores the grey-level signals for the sub-pixels 131-134 in the buffers of the data lines S1-S4, and stores the grey-level signals for the sub-pixels 141-144 in the buffers of the data lines S5-S8. In a time period 920, the gate line G1 is at the high level, and the grey-level signals in the buffers are transmitted to the sub-pixels 131-134 through the data lines S1-S4 and to the sub-pixels 141-144 through the data lines S5-S8.

Figure 3:
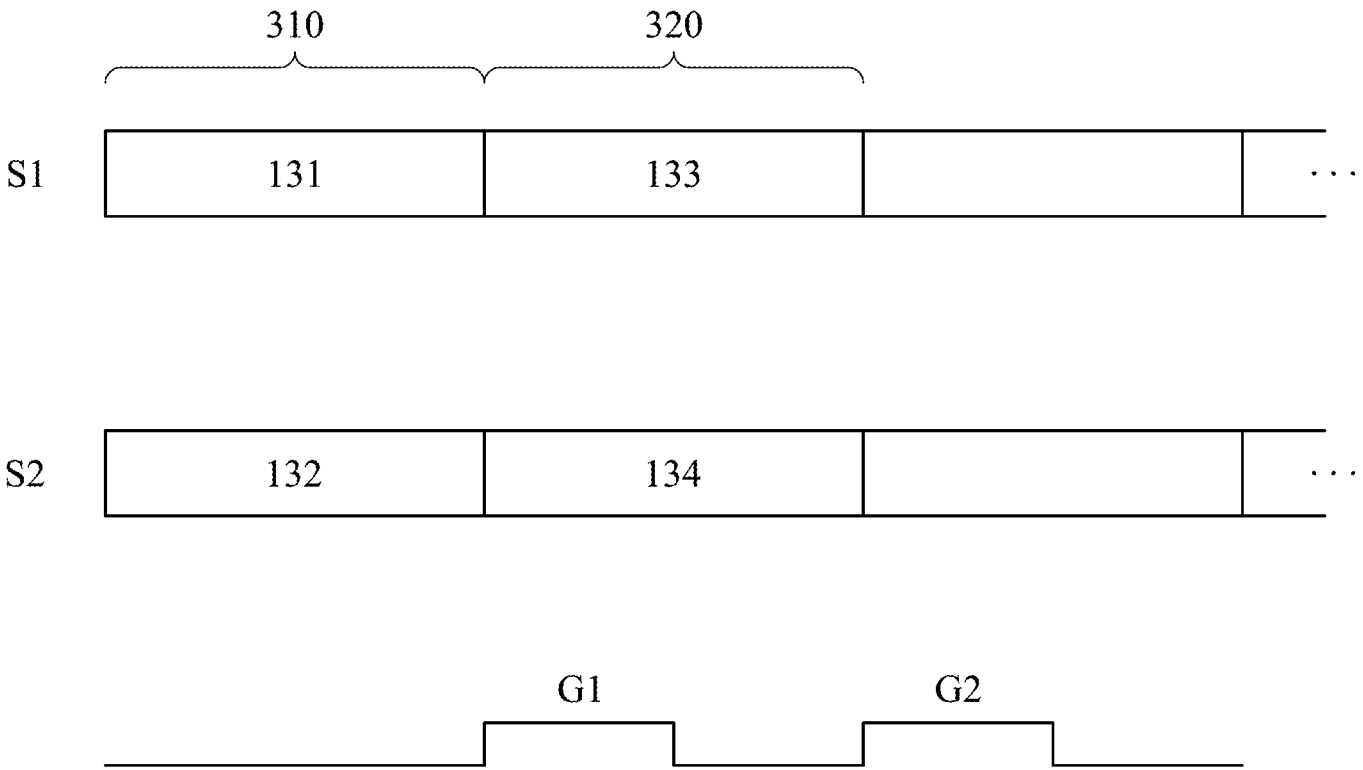
FIG. 3 is a signal timing diagram in accordance with an embodiment.

From another aspect, in the aforementioned embodiments, every n sub-pixels in each column are electrically connected to the same gate line and electrically connected to n different data lines in which n is a positive integer greater than or equal to 2. The n sub-pixel are turned on and charged simultaneously. In the embodiments of FIG. 1 to FIG. 3, n=2; in the embodiments of FIG. 4 to FIG. 6, n=3; in the embodiments of FIG. 7 to FIG. 9, n=4. The integer n may be greater than 4 in other embodiments. Note that the time period 910 is longer than the time period 610 which is longer than the time period 310.

Two designs are adopted in the disclosure. The first design is to dispose three sub-pixels of one pixel vertically, and in this case the number of the data lines becomes ⅓ times of the original and the charging time for each sub-pixel becomes ⅓ times of the original. The second design is to electrically connect every n sub-pixels in one column to the same gate line and different n data lines, and by doing so the number of the data lines becomes n times of the original, and the charging time of each sub-pixel becomes n times of the original. Therefore, when combining the two designs, the number of the data lines becomes n/3 times of the original, and the charging time of each sub-pixel becomes n/3 time of the original. For example, assume the resolution of the display panel 130 is 7680×4320, displaying time for each frame is 1/60 second, and each source driving circuit 120 can provide 960 data lines. In a conventional display panel, three sub-pixels of one pixel are disposed horizontally, and therefore 7680×3=23040 data lines and 23040÷960=24 source driving circuits are needed, and the charging time for each sub-pixel is 1÷60÷4320=3.858 micro seconds. After adopting the first design, 7680 data lines and 7680÷960=8 source driving circuits are needed, and the charging time for each sub-pixel is 1÷60÷(4320×3)=1.286 micro seconds. Although the first design can change the number of the source driving circuits and the charging time, it is not flexible. After adopting both of the two designs, 7680×n data lines and 8×n source driving circuits are needed, and the charging time for each sub-pixel is 1.286×n micro seconds. Different values of the positive integer n are selected for different products that can strike a proper balance between the number of the source driving circuits (i.e. cost) and the charging time.

The display panel 130 may be a fringe field switching (FFS) panel, an in-plane switching (IPS) panel, a twisted nematic (TN) panel, a vertical alignment (VA) panel or other suitable panels.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A display device comprising:

a display panel comprising a plurality of sub-pixels arranged in a plurality of rows and a plurality of columns, wherein three first sub-pixels of the sub-pixels have different colors and constitute one pixel, and the first sub-pixels are disposed in a same one of the columns;

a gate driving circuit electrically connected to a plurality of gate lines, wherein a number of the gate lines is less than a number of the rows, each of the gate lines corresponds to at least two of the rows, and each of the gate lines is electrically connected to at least two of the sub-pixels in each of the columns; and a source driving circuit electrically connected to a plurality of data lines, wherein a number of the data lines is greater than a number of the columns, each of the columns corresponds to at least two of the data lines, and the at least two of the data lines alternatively and electrically connected to the sub-pixels in the corresponding column, wherein two of the first sub-pixels are electrically connected to a same one of the gate lines and respectively and electrically connected to different two of the data lines, wherein in a period that the gate driving circuit turns on the two of the first sub-pixels, the source driving circuit transmits two grey-level signals to the two of the first sub-pixels through the different two of the data lines respectively.

2. A display device comprising:

a display panel comprising a plurality of sub-pixels arranged in a plurality of rows and a plurality of columns, wherein three first sub-pixels of the sub-pixels have different colors and constitute one pixel, and the first sub-pixels are disposed in a same one of the columns;

a gate driving circuit electrically connected to a plurality of gate lines, wherein a number of the gate lines is less than a number of the rows, each of the gate lines corresponds to at least two of the rows, and each of the gate lines is electrically connected to at least two of the sub-pixels in each of the columns; and a source driving circuit electrically connected to a plurality of data lines, wherein a number of the data lines is greater than a number of the columns, each of the columns corresponds to at least two of the data lines, and the at least two of the data lines alternatively and electrically connected to the sub-pixels in the corresponding column, wherein the first sub-pixels are electrically connected to a same one of the gate lines and respectively and electrically connected to different three of the data lines, wherein in a period that the gate driving circuit turns on the first sub-pixels, the source driving circuit transmits three grey-level signals to the first sub-pixels through the different three of data lines.

3. A display device comprising:

a display panel comprising a plurality of sub-pixels arranged in a plurality of rows and a plurality of columns, wherein three first sub-pixels of the sub-pixels have different colors and constitute one pixel, and the first sub-pixels are disposed in a same one of the columns;

a gate driving circuit electrically connected to a plurality of gate lines, wherein a number of the gate lines is less than a number of the rows, each of the gate lines corresponds to at least two of the rows, and each of the gate lines is electrically connected to at least two of the sub-pixels in each of the columns; and a source driving circuit electrically connected to a plurality of data lines, wherein a number of the data lines is greater than a number of the columns, each of the columns corresponds to at least two of the data lines, and the at least two of the data lines alternatively and electrically connected to the sub-pixels in the corresponding column, wherein the first sub-pixels and a second sub-pixel are disposed in a same one of the columns, the first sub-pixels and the second sub-pixel are electrically connected to a same one of the gate lines and respectively and electrically connected to different four of the data lines, wherein in a period that the gate driving circuit turns on the first sub-pixels and the second sub-pixel, the source driving circuit transmits four grey-level signals to the first sub-pixels and the second sub-pixel through the different four of the data lines respectively.

* * * * *